US006965086B2

(12) United States Patent
Suzuki et al.

(10) Patent No.: US 6,965,086 B2
(45) Date of Patent: Nov. 15, 2005

(54) ELECTRONIC DEVICE

(75) Inventors: Takahiro Suzuki, Yokohama (JP); Masaaki Satou, Sagamihara (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/106,128

(22) Filed: Apr. 14, 2005

(65) Prior Publication Data

US 2005/0230236 A1 Oct. 20, 2005

(30) Foreign Application Priority Data

Apr. 16, 2004 (JP) ..... 2004-121115

(51) Int. Cl.[7] ..... H01H 13/14
(52) U.S. Cl. ..... 200/345
(58) Field of Search ..... 200/5 A, 341–345, 200/517, 520, 296; 400/490, 491, 491.2, 400/495, 495.1, 496; 341/22; 345/168, 169

(56) References Cited

U.S. PATENT DOCUMENTS 5,418,530 A * 5/1995 Moore et al. ..... 341/22
5,496,982 A * 3/1996 Tsai ..... 200/345
6,184,481 B1 * 2/2001 Chen ..... 200/5 A
6,335,500 B1 * 1/2002 Chi et al. ..... 200/341

FOREIGN PATENT DOCUMENTS

JP 2000-340071 12/2000
JP 2001-307595 11/2001

* cited by examiner

*Primary Examiner*—Michael A. Friedhofer

(74) *Attorney, Agent, or Firm*—RatnerPrestia

(57) ABSTRACT

A button holding base member includes a button housing portion. A button is so housed in the button housing portion as to move in a button pushing direction. A button holder is assembled from the back side of an operation panel with the button. The button holder and the button interpose the operation panel inbetween thereby to prevent an illuminating light leakage. Moreover, the button holding base member and the button holder include a sliding portion at a position away from the button housing portion. As a result, the sliding structure is arranged independently of the illuminating light leakage preventing structure thereby to elongate the sliding distance. The stability of the button can be improved while retaining the illuminating light leakage preventing function.

2 Claims, 2 Drawing Sheets

ELECTRONIC DEVICE

BACKGROUND OF THE INVENTION

1. Field of the Invention

The present invention relates to an electronic device having a push button structure with an illuminating function and, more particularly, to a prevention of an illuminating light leakage and a reduction in the looseness of a button operation.

2. Background

In the prior art, there is known an electronic device, which is provided with a push button having an illuminating function, as shown in FIG. 2. In the electronic device 100 of FIG. 2, an operation panel 102 is a button holding base member. The operation panel 102 is provided with a cylindrical button housing portion 104. Into this button housing portion 104, there is inserted a button 106, which is made of a resin material for transmitting an illuminating light.

On the rear side of the operation panel 102, on the other hand, there is arranged a printed-circuit board 108. On this printed-circuit board 108, there are mounted a switch 110 and a LED light source 112. The switch 110 and the LED light source 112 are disposed at positions corresponding to the button 106.

As shown in FIG. 2, the inner circumference of the button housing portion 104 and the outer circumference of the button 106 constitute a sliding portion 114. An illuminating light leakage preventing portion 116 is disposed on the front side of the sliding portion 114. Here, the front side is the side close to the surface of the operation panel 102.

In the illuminating light leakage preventing portion 116, the button housing portion 104 is provided with a step 118. As a result, the button housing portion 104 is expanded on the front side. The button 106 is also provided with a step 120 corresponding to the step 118 of the button housing portion 104. As a result, the button 106 has an expanded head portion. This step structure prevents the illuminating light leakage. Moreover, a clearance corresponding to the button stroke is established between the step 120 of the button 106 and the step 118 of the button housing portion 104.

In the electronic device 100 of FIG. 2, the LED light source 112 is turned ON so that the light passes through the button 106 so that the button 106 glows. The leakage of the light is prevented by the illuminating light leakage preventing portion 116. When the button 106 is pushed, the button housing portion 104 and the button 106 slide in the sliding portion 114.

In the conventional structure of FIG. 2, as described above, both the button sliding structure and the illuminating light leakage preventing structure are juxtaposed to each other in the button housing portion 104.

Another illuminating light leakage preventing structure of the button with the illuminating function is disclosed, for example, in JP-A-2000-340071 (pages 3 and 4, FIG. 1) and JP-A-2001-307595 (pages 4 and 5, FIG. 1). In these Publications, the illuminating light leakage of a seesaw button is prevented by using the flange on the button outer circumference.

In the conventional electronic device of FIG. 2, the sliding structure and the illuminating light leakage preventing structure are juxtaposed in the button housing portion. Therefore, the illuminating light leakage preventing structure has to be retained by sacrificing the space for the sliding structure. In FIG. 2, the illuminating light leakage preventing structure needs the space for the button stroke so that the sliding distance is shortened. This short sliding distance lowers the ability of preventing the looseness of the button.

SUMMARY OF THE INVENTION

The invention has been conceived in view of the background thus far described. An object of the invention is to provide an electronic device capable of retaining the sliding distance to prevent the looseness while retaining the illuminating light leakage preventing function.

According to the invention, there is provided an electronic device comprising: a button holding base member including a button housing portion; a button so housed in the button holding base member as to move in a button pushing direction; and a button holder assembled with the button from the back side of the button holding base member, wherein the button holder and the button interpose the button holder inbetween, and wherein the button holder and the button holding base member include a sliding portion at a position away from the button housing portion.

As described hereafter, other aspects of the invention exist. Thus, this summary of the invention is intended to provide a few aspects of the invention and is not intended to limit the scope of the invention described and claimed herein.

BRIEF DESCRIPTION OF THE DRAWINGS

The accompanying drawings are incorporated in and constitute a part of this specification. The drawings exemplify certain aspects of the invention and, together with the description, serve to explain some principles of the invention.

DETAILED DESCRIPTION

Figure 1:
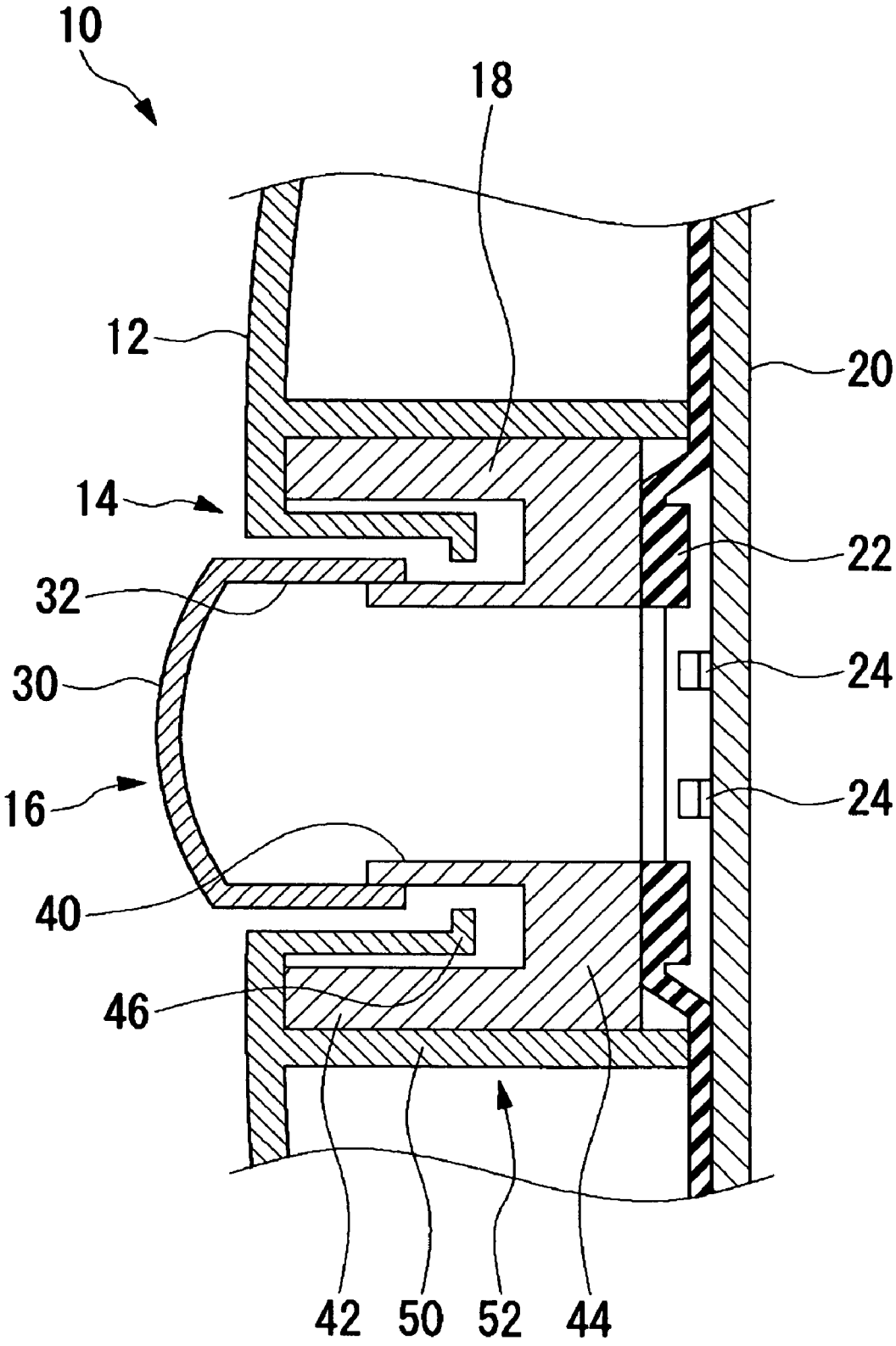
FIG. 1 is a sectional view of an electronic device in an embodiment of the invention.
Figure 2:
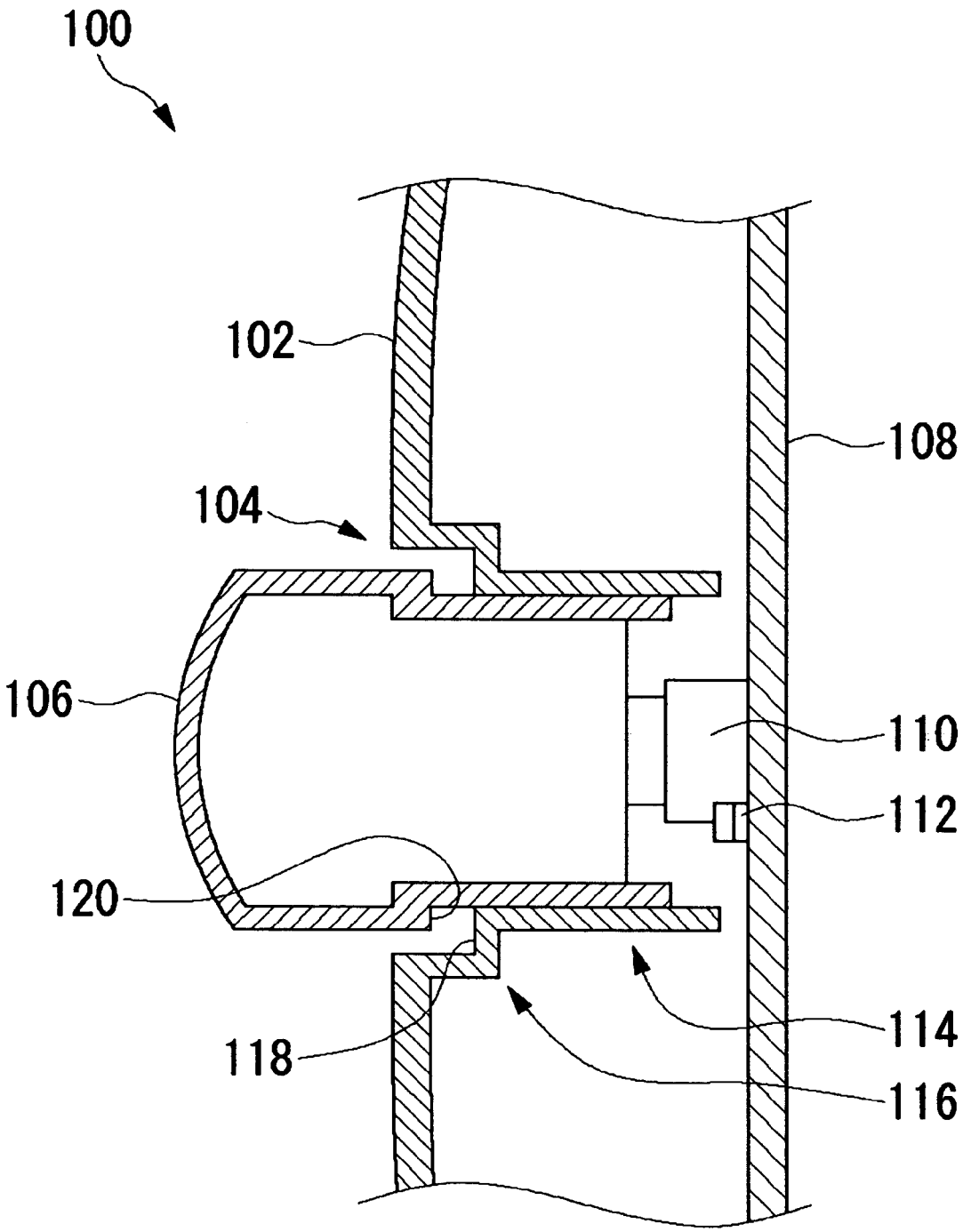
FIG. 2 is a sectional view of an electronic device of the prior art.

The following detailed description refers to the accompanying drawings. Although the description includes exemplary implementations, other implementations are possible and changes may be made to the implementations described without departing from the spirit and scope of the invention. The following detailed description and the accompanying drawings do not limit the invention. Instead, the scope of the invention is defined by the appended claims.

An electronic device of the invention comprises: a button holding base member including a button housing portion; a button so housed in the button holding base member as to move in a button pushing direction; and a button holder assembled with the button from the back side of the button holding base member. The button holder and the button interpose the button holder inbetween. The button holder and the button holding base member include a sliding portion at a position away from the button housing portion. The button holder and the button are associated with each other to interpose the button holding base member inbetween. The sliding portion of the button holder and the button holding base member may be at a position transversely away from the button housing with respect to the button pushing direction.

With this construction, the button and the button holder interpose the button holding base member, more specifically the button housing portion of the button holding base member is contained by the assembly of the button and the button holder, thereby to retain that the illuminating light leakage preventing function. Moreover, the button holding base member and the button holder include the sliding portion at a position away from the button housing portion. Therefore, the illuminating light leakage preventing structure and the sliding structure are independent of each other so that the sliding distance (i.e., the distance of the contacting portions of the sliding members) can be elongated. Thus, the sliding distance can be retained to prevent the looseness while retaining the illuminating light leakage preventing function.

Moreover, the button holder may include an inner cylinder portion fitted with the button, and an outer cylinder portion spaced on the outer side from the inner cylinder portion. Moreover, the outer cylinder portion may slide with respect to the button holding base member.

This structure is enabled to retain the sliding distance by using the outer cylinder portion of the button holder. As a result, it is possible to prevent the looseness effectively.

Thus, the electronic device has a preferable constitution of the combination of the button holder and the button so that it can improve the stability of the button while retaining the illuminating light leakage preventing function.

An electronic device of this embodiment is described with reference to the accompanying drawing. The electronic device of the embodiment is characterized in a button device. Therefore, this button device is mainly described in the following. The electronic device is exemplified by a car-audio device.

FIG. 1 shows the electronic device of the embodiment. In the electronic device 10 of FIG. 1, an operation panel 12 is made of a resin and corresponding to a button holding base member. In the following, the surface side of the operation panel 12 is called the "front side", and the opposite side (i.e., the inner side of the electronic device 10) is called the "rear side" or the "back side".

The operation panel 12 is provided with a cylindrical button housing portion 14 to protrude rearward. A button 16 is housed in the button housing portion 14. A button holder 18 is assembled with the button 16 from the back side of the operation panel 12. The button 16 and the button holder 18 can moved in a button pushing direction in the button housing portion 14.

A printed-circuit board 20 is arranged on the rear side of the operation panel 12. The printed-circuit board 20 is fixed, although not shown so, in the casing of the electronic device. The operation panel 12 also forms part of the casing. The printed-circuit board 20 may also be fixed on the operation panel 12.

A rubber contact switch 22 and an LED light source 24 are mounted on the printed-circuit board 20. The rubber contract switch 22 makes contact with the rear side face of the button holder 18. On the other hand, the light emitting diode 24 is positioned on the rear of the button 16.

The button 16 is made of a resin material for transmitting alight. The button 16 has ahead portion 30 and a trunk portion 32. The head portion 30 is pushed by the operator. On the other hand, the trunk portion 32 is formed in a cylindrical shape and housed in the button housing portion 14.

The button holder 18 has an inner cylinder portion 40 and an outer cylinder portion 42. The inner cylinder portion 40 and the outer cylinder portion 42 are jointed at their rear portions by a joint portion 44. Here, the inner side is the side closer to the center of the button 16.

The inner cylinder portion 40 of the button holder 18 is press-fitted in the inner side of the trunk portion 32 of the button 16. As a result, the button holder 18 and the button 16 are fitted on and assembled with each other.

The inner cylinder portion 40 and the outer cylinder portion 42 of the button holder 18 are spaced from each other. As a result, the assembly of the button 16 and the button holder 18 has a groove between "the inner cylinder portion 40 and the trunk portion 32 of the button 26" and "the outer cylinder portion 42". In this groove, there is contained (inserted) the button housing portion 14 of the operation panel 12. This button housing portion 14 protrudes inward at its leading end to form a flange portion 46. This flange portion 46 confronts the step on the moving side (i.e., the step of the trunk portion 32 of the button 16 and the inner cylinder portion 40 of the button holder 18). By this structure, the operation panel 12 is interposed between the button 16 and the button holder 18. More particularly, the button housing portion 14 of the operation panel 12 (cylindrical portion protruding backward from the operation panel 12) is contained by the assembly of the button 16 and the button holder. As a result, the light is prevented from leaking from between the button 16 and the operation panel 12.

On the other hand, the operation panel 12 is provided with a sliding cylinder portion 50 on the outer side of the outer cylinder portion 42 of the button holder 18. The sliding cylinder portion 50 protrudes rearward from the operation panel 12. The inner face of the sliding cylinder portion 50 makes contact with the outer face of the outer cylinder portion 42. The sliding cylinder portion 50 and the outer cylinder portion 42 form a sliding portion 52.

In this sliding portion 52, the leading end of the sliding cylinder portion 50 extends so far as to reach the printed-circuit board 20. Thus, in this embodiment, the sliding portion 52 is independent of the illuminating light leakage preventing structure so that the sliding distance can be elongated. This sliding distance is the length in the sliding direction of the contacting portions of the sliding members.

On the other hand, the button holder 18 is made of a resin. However, this resin material for the button holder 18 need not transmit any light. A material excellent in the sliding performance is applied to the button holder 18.

The actions of the electronic device 10 of this embodiment is described in the following. In the electronic device 10, the LED light source 24 is lit. The light of the LED light source 24 passes through the inner cylinder portion 40 of the button holder 18 and the trunk portion 32 of the button 16 and illuminates the head portion 30 of the button 16 so that the button 16 looks bright.

The button housing portion 14 of the operation panel 12 is interposed between the button 16 and the button holder 18. The button housing portion 14 of the operation panel 12 (portion protruding backward from the button holding base member) is contained or covered by the assembly of the button 16 and the button holder so as to prevent passing of the light through the clearance of the button and the button holding base member (or the operation panel 12). As a result, no light leaks from the clearance between the button 16 and the operation panel 12.

When the head portion 30 of the button 16 is pushed, the assembly of the button 16 and the button holder 18 moves rearward. At this time, a slide occurs at the sliding portion 52. This sliding portion 52 is composed of the outer cylinder portion 42 of the button holder 18 and the sliding cylinder portion 50 of the operation panel 12. This sliding distance (i.e., the length of the contacting portions) is so long that the button 16 and the button holder 18 can be effectively prevented from becoming loose.

The button 16 and the button holder 18 move together, as described above. The rubber contract switch 22 is pushed by the button holder 18 to come into contact with the printed-circuit board 20. As result, the switch is closed so that the electric current flows through the printed-circuit board 20.

According to the electronic device 10 of the embodiment of the invention, as has been described hereinbefore, the button holding base member is interposed between the button 16 and the button holder 18. As a result, the illuminating light leakage preventing function is retained in the relation between the button 16 and the button holding base member. Moreover, the button holding base member and the button holder 18 constitute the sliding portion 52 at a position away from the button housing portion 14. As a result, the illuminating light leakage preventing structure and the sliding structure can be individually disposed to elongate the sliding distance. Thus, the sliding distance can be retained to suppress the looseness while retaining the illuminating light leakage preventing function, thereby to improve the stability in the button operation.

According to the electronic device 10 of the embodiment, moreover, the button holder 18 is composed of the inner cylinder portion 40 and the outer cylinder portion 42, and this outer cylinder portion 42 slides with respect to the button holding base member. By using the outer cylinder portion, the sliding distance can be retained to prevent the looseness effectively.

Here, the head portion of the button 16 may have an arbitrary shape, as taken from the front, although not shown in FIG. 1. For example, the button 16 has a square shape. Then, the shapes of the trunk portion 32 of the button 16, the inner cylinder portion 40 of the button holder 18, and the button housing portion 14 of the operation panel 12 may also be square. Nevertheless, the button 16 may also have a circular shape or another.

In the embodiment, moreover, the rubber contract switch 22 may be changed to have an arbitrary shape. Alternatively, there may also be provided a switch other than the rubber contact type. Moreover, the LED light source 24 may also be modified into an arbitrary light source. Still moreover, the illuminating light leakage preventing structure may also be modified in the shape and constitution within a range to prevent the illuminating light leakage.

Persons of ordinary skill in the art will realize that many modifications and variations of the above embodiments may be made without departing from the novel and advantageous features of the present invention. Accordingly, all such modifications and variations are intended to be included within the scope of the appended claims. The specification and examples are only exemplary. The following claims define the true scope and spirit of the invention.

What is claimed is:

1. An electronic device comprising:

a button holding base member including a button housing portion;

a button so housed in said button holding base member as to move in a button pushing direction; and a button holder assembled with said button from the back side of said button holding base member, wherein said button holder and said button interpose said button holder inbetween, and wherein said button holder and said button holding base member include a sliding portion at a position away from said button housing portion.

2. An electronic device according to claim 1, wherein said button holder includes an inner cylinder portion fitted with said button, and an outer cylinder portion spaced on the outer side from said inner cylinder portion, and wherein said outer cylinder portion slides with respect to said button holding base member.

* * * * *